US010046349B2

(12) United States Patent
Tada et al.

(10) Patent No.: US 10,046,349 B2
(45) Date of Patent: Aug. 14, 2018

(54) TRIGGER-TYPE PUMP DISPENSER

(71) Applicants: CANYON CORPORATION, Tokyo (JP); Mieko Tada, Tokyo (JP)

(72) Inventors: Tetsuya Tada, Tokyo (JP); Mitsuaki Shaduki, Yamaguchi (JP)

(73) Assignee: CANYON CORPORATION, Tokyo (JP)

( * ) Notice: Subject to any disclaimer, the term of this patent is extended or adjusted under 35 U.S.C. 154(b) by 0 days.

(21) Appl. No.: 15/328,828

(22) PCT Filed: Jul. 17, 2015

(86) PCT No.: PCT/JP2015/003624
§ 371 (c)(1),
(2) Date: Jan. 24, 2017

(87) PCT Pub. No.: WO2016/013196
PCT Pub. Date: Jan. 28, 2016

(65) Prior Publication Data

US 2017/0209883 A1 Jul. 27, 2017

(30) Foreign Application Priority Data

Jul. 24, 2014 (JP) ..... 2014-151134

(51) Int. Cl.
*B05B 11/00* (2006.01)

(52) U.S. Cl.
CPC ..... *B05B 11/3011* (2013.01); *B05B 11/3045* (2013.01); *B05B 11/3067* (2013.01); *B05B 11/3077* (2013.01)

(58) Field of Classification Search
CPC . B05B 11/0027; B05B 11/3059; B05B 11/30; B05B 11/3001; B05B 11/3002;
(Continued)

(56) References Cited

U.S. PATENT DOCUMENTS 1,937,344 A * 11/1933 Hollingsworth .... B05B 11/3009 222/385
3,877,616 A * 4/1975 Stevens ..... B05B 11/3001 222/321.9
(Continued)

FOREIGN PATENT DOCUMENTS

JP 52-81709 A 7/1977
JP 9-249248 A 9/1997
(Continued)

OTHER PUBLICATIONS

International Search Report dated Dec. 15, 2015 in PCT/JP2015/003624 and English translation thereof.

*Primary Examiner* — Patrick M Buechner
(74) *Attorney, Agent, or Firm* — Muncy, Geissler, Olds & Lowe, P.C.

(57) ABSTRACT

A pump dispenser includes a housing, a piston structure, a spring, a trigger and a valve. The housing has a front cylinder part and a rear inverted-L-shaped grip part that are integrally formed, a nozzle base that is attached to the housing and that has a front nozzle part mounted thereon. The piston structure is configured of a hollow-shaped piston and a hollow-shaped piston shaft and that slides inside the cylinder part. The spring presses the piston structure upward. The trigger is positioned above the housing, has a front tip rotatably mounted on the housing, and has a mid part where a tip of the hollow-shaped piston shaft abuts. The valve rod is disposed at a center part of the cylinder part.

5 Claims, 12 Drawing Sheets

(58) Field of Classification Search
CPC ..... B05B 11/3009; B05B 11/3011; B05B 11/3012; B05B 11/3014; B05B 11/3015; B05B 11/305; B05B 11/3056; B05B 11/3057; B05B 11/3067
See application file for complete search history.

(56) References Cited

U.S. PATENT DOCUMENTS 4,061,250 A * 12/1977 Tada ..... B05B 11/0016 222/321.8
4,124,148 A 11/1978 Vieler et al.
4,186,855 A * 2/1980 Edman ..... B05B 11/3057 222/321.8
5,219,098 A * 6/1993 Tada ..... B05B 11/3001 222/153.06
6,095,377 A * 8/2000 Sweeton ..... B05B 11/3011 222/383.1
6,230,935 B1 * 5/2001 Mack ..... B05B 11/0048 222/137
2004/0182884 A1 * 9/2004 Tada ..... B05B 11/3057 222/153.13
2010/0276454 A1 * 11/2010 Espinoza ..... B05B 11/3011 222/153.13
2011/0284578 A1 * 11/2011 Wong ..... A47G 19/183 222/40
2014/0061252 A1 * 3/2014 Sweeton ..... B05B 11/0037 222/321.8
2016/0193617 A1 * 7/2016 Tada ..... B05B 11/0067 222/324
2017/0291184 A1 * 10/2017 Tada ..... B05B 11/3001

FOREIGN PATENT DOCUMENTS

JP 2008-87808 A 4/2008
JP 2009-90201 A 4/2009
JP 2010-184182 A 8/2010

* cited by examiner

TRIGGER-TYPE PUMP DISPENSER

TECHNICAL FIELD

The present invention relates to a trigger-type pump dispenser attached to a container to efficiently inject a liquid accommodated inside.

BACKGROUND ART

Conventionally, as a tool attached to a container to discharge or inject an inner liquid, a trigger-type pump dispenser has been widely used.

The trigger-type pump dispenser normally includes a piston and a cylinder. With the piston being moved, a pressure is applied to the inside of the cylinder to cause a liquid to be injected.

Types of this trigger-type pump dispenser are classified based on how to move the piston.

As one of those, for example, there is a trigger-type pump dispenser of a type in which a trigger is pulled in by four fingers (refer to PTL 1 and PTL 2).

These trigger-type pump dispensers disclosed in PTL 1 and PTL 2 are provided with a trigger at front. When the front trigger is gripped by hand to be moved rearward, the piston is pressed down in an interlocked manner with the movement of the trigger to increase a liquid pressure inside the cylinder.

As a result, a liquid is injected at a dash from a nozzle part.

Also, conventionally, a trigger-type pump dispenser of a type has been suggested in which a trigger is disposed above a main body and a rear end of the trigger is pushed in to press down the piston in an interlocked manner with the movement of the trigger to increase a liquid pressure inside the cylinder (refer to PTL 3).

Furthermore, this trigger-type pump dispenser described in PTL 3 is configured as follows.

That is, the structure of this trigger-type pump dispenser described in PTL 3 is such that a trigger-type pump dispenser attachable to a container includes a cylinder part, a piston structure slidable inside the cylinder, a housing part mounted on the cylinder part, a grip part integrally formed with the housing part, a trigger part mounted on the housing part and coupled to the piston structure via a crank part, and a cap for attaching the cylinder part to a container main body.

And, the piston structure has a bendable long nozzle part and a piston part integrated. With the trigger part pressed down and made closer to the grip part, the piston part is pressed down via the crank part to apply a pressure inside the cylinder part to cause a liquid to be discharged through a long nozzle part.

CITATION LIST

Patent Literature

PTL 1: Japanese Patent Application Laid-Open No. 2005-219003

PTL 2: Japanese Patent Application Laid-Open No. 2006-198446

PTL 3: Japanese Patent Application Laid-Open No. 2010-184182

SUMMARY OF INVENTION

Technical Problem

However, in these trigger-type pump dispensers described in the above-described PTL 1 and PTL 2, when the trigger is pulled in, the whole surrounding of the trigger-type pump dispenser has to be gripped by the palm and the trigger has to be pulled in by using fingers in a lateral direction.

Thus, when a child with small hands, a handicapped person with decreased grip power or finger power, or the like handles the dispenser, the state of gripping the trigger is shallow, making it difficult to put power.

Also, since the whole is gripped by using four fingers, if a liquid or the like is affixed to the surrounding of the main body of the trigger-type pump dispenser, that is disadvantageously affixed to the hand to cause soiling.

In particular, a finger positioned directly below the nozzle tends to get soiled.

Also, the trigger-type pump dispenser described in PTL 3 can solve the disadvantages as described above regarding PTL 1 and PTL 2.

However, there is a problem as follows.

That is, with the trigger part coupled to the piston structure via the crank part and with the long nozzle part bent when the trigger part is pushed in, there is a problem in which an extra space is required in the housing part.

Furthermore, in the trigger-type pump dispenser described in PTL 3, since a liquid is discharged by pressing down and making the trigger part closer to the grip part, it can be said that operability is excellent.

In the future, more usable one is desired in view of gripping capability.

Thus, the Applicant has already suggested, as Japanese Patent Application No. 2013-185763 (Japanese Patent Application Laid-Open No. 2015-51398), a trigger-type pump dispenser with high gripping capability, efficient transmission of finger power to the trigger part at the time of injection, and excellent operation.

Meanwhile, this trigger-type pump dispenser is characterized in that, in short, in a trigger-type pump dispenser in which, in a state in which a grip part is gripped, a trigger part above the grip part is pressed down to cause a liquid inside a cylinder part to be injected from a nozzle part, a finger abutting part of the grip part is at the rear of a force point of the trigger part.

However, when the trigger part is pressed downward with the grip part and the trigger part being gripped, the piston part also moves downward accordingly.

In this case, when the piston part moves downward, the nozzle part also moves downward.

Therefore, a problem remains in which the position of the nozzle part vertically moves when a liquid is injected.

The present invention has been made based on this background art, and an object of the present invention is to provide a trigger-type pump dispenser capable of accurately defining a liquid injecting direction without vertical movement of the position of a nozzle part, having a good grip capability without soiling of hands, having efficient transmission of finger power to a trigger part at the time of injection, and being excellent in operability.

Solution to Problems

With diligent studies to solve the above problems, the inventors have found that the above problems can be solved by intervening a hollow-shaped piston shaft between the trigger and the piston, leading to completion of the present invention.

The present invention resides in (1) a trigger-type pump dispenser attachable to a container, including a housing with a front cylinder part and a rear inverted-L-shaped grip part integrally formed, a nozzle base attached to the housing and having a front nozzle part mounted thereon, a piston structure configured of a hollow-shaped piston and a hollow-shaped piston shaft and sliding inside the cylinder part, a spring which presses the hollow-shaped piston and the hollow-shaped piston shaft upward, a trigger positioned above the housing, having a front tip rotatably mounted on the housing, and having a mid part where a tip of the piston shaft abuts, and a valve rod disposed at a center part inside the cylinder part, wherein the hollow-shaped piston is integrally formed so that a large-diameter piston part, a small-diameter piston part, and an intermediate-diameter mid part have a same axis center, and the small-diameter piston part has a lip part inside, the valve rod has, at its tip part, a valve body having a valve function in cooperation with the lip part, and has an enlarged part at its base end part, and a finger abutting part of the inverted-L-shaped grip part is at rear of a force point of a thumb pad part of the trigger.

The present invention resides in the trigger-type pump dispenser according to the above (1), in which (2) the hollow-shaped piston shaft has its upper part formed into a bifurcated part, a tip part of the bifurcated part abutting on the trigger, and its lower part incorporated in the hollow-shaped piston.

The present invention resides in the trigger-type pump dispenser according to the above (2), in which (3) a support shaft protrude from each outer side surface of the tip part of the bifurcated part.

The present invention resides in the trigger-type pump dispenser according to the above (1), in which (4) the small-diameter piston part of the piston structure is freely slidable inside a hollow part in a longitudinal direction formed in the nozzle base part, and movement of the piston structure is not transmitted to the nozzle base.

The present invention resides in the trigger-type pump dispenser according to any one of the above (1) to (4), in which (5) a stopper is inserted between the trigger and the inverted-L-shaped grip part.

Note that a structure obtained by combining the structures of the above respective inventions as appropriate is also adoptable as long as the structure goes along the object of the present invention.

Advantageous Effects of Invention

The trigger-type pump dispenser according to the present invention has the following effects.

Even if the trigger vertically rotates, the position of the nozzle part does not change, and therefore the liquid injecting direction can be accurately defined toward a target.

Also, since vertical movement of the hollow-shaped piston can be made via the hollow-shaped piston shaft, the inner space of the housing can be reduced.

Also, since the inverted-L-shaped grip part is positioned under the trigger, when the trigger for injecting the liquid is pulled in, a grip is good, and the whole trigger-type pump dispenser is not required to be gripped.

Also, in a state in which four fingers are hooked on the inverted-L-shaped grip part, the thumb is put on the trigger, and a simple press downward is enough.

Thus, the dispenser can be easily handled even by a child with small hands, a handicapped person with decreased grip power or finger power, or the like.

Furthermore, even if a liquid is affixed to the trigger-type pump dispenser itself, the hand is away from the trigger-type pump dispenser itself, and is therefore not soiled.

Also, the trigger-type pump dispenser is such that, in a state in which the inverted-L-shaped grip part is gripped, the trigger above the inverted-L-shaped grip part is pressed down to cause a liquid inside the cylinder part to be injected from the nozzle part. Since the finger abutting part of the inverted-L-shaped grip part is at the rear of the force point of the thumb pad part of the trigger, a grip is good, holding capability is high (that is, gripping capability is good), power is efficiently transmitted, and operability is also excellent.

Also, the small-diameter piston part of the piston structure is freely slidable inside the hollow part in the longitudinal direction formed in the nozzle base part, and movement of the piston structure is not transmitted to the nozzle base. Therefore, the injecting direction can be accurately defined toward the target.

Also, with the stopper inserted between the trigger and the inverted-L-shaped grip part, it is possible to prevent the trigger from being pressed down due to some circumstances during storage or during delivery of the trigger-type pump dispenser.

BRIEF DESCRIPTION OF DRAWINGS

FIG. 5 depicts the nozzle base for use in the trigger-type pump dispenser according to the embodiment of the present invention, in which

FIG. 6 depicts a piston for use in the trigger-type pump dispenser according to the embodiment of the present invention, in which

FIG. 7 depicts a piston shaft for use in the trigger-type pump dispenser according to the embodiment of the present invention, in which

FIG. 8 depicts a state in which the nozzle base, the piston, and the piston shaft for use in the trigger-type pump dispenser according to the embodiment of the present invention are assembled, in which

FIG. 9 depicts the trigger for use in the trigger-type pump dispenser according to the embodiment of the present invention, in which

FIG. 10 depicts a general outline of a first valve for use in the trigger-type pump dispenser according to the embodiment of the present invention, in which

DESCRIPTION OF EMBODIMENTS

A trigger-type pump dispenser A according to an embodiment of the present invention is described below with reference to the drawings.

The trigger-type pump dispenser A according to the embodiment of the present invention has a structure in which, with an inverted-L-shape grip part 11B gripped and a thumb pad part 13*a* of a trigger 13 pressed downward by using the thumb, a piston structure 14 is moved down to provide a compression force to a liquid for injection from a nozzle part 11C.

Figure 1:
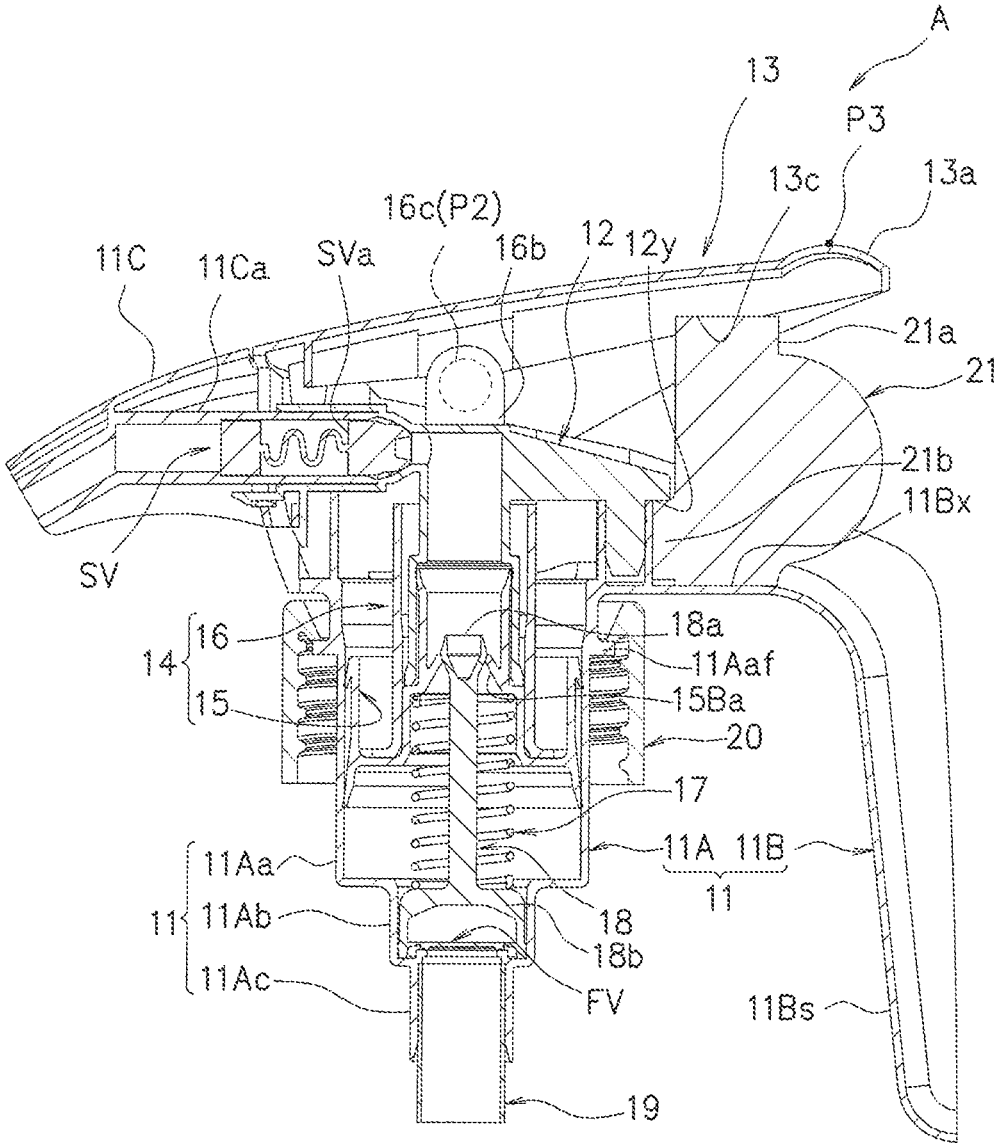
FIG. 1 is a longitudinal sectional view of a center part of a trigger-type pump dispenser according to an embodiment of the present invention, depicting a state in which a stopper is inserted between a trigger and an inverted-L-shaped grip part.

FIG. 1 is a longitudinal sectional view of a center part of the trigger-type pump dispenser A according to the embodiment of the present invention, depicting a state in which a stopper 21 is inserted between the trigger 13 and the inverted-L-shaped grip part 11B.

The stopper 21 is inserted in order to prevent the trigger 13 from being pressed down due to some circumstances during storage or during delivery of the trigger-type pump dispenser A.

Figure 2:
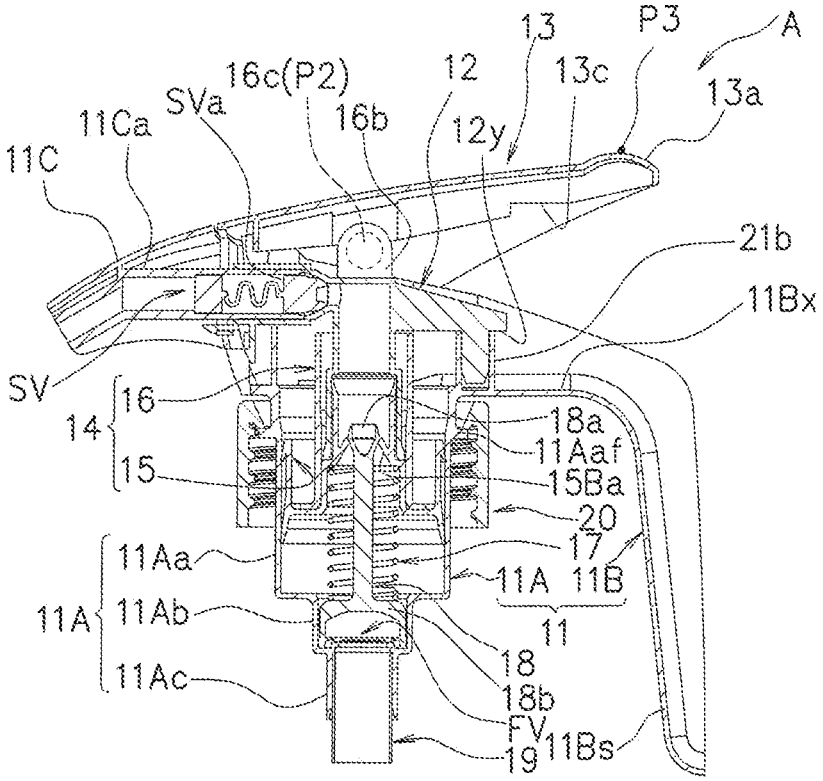
FIG. 2 is a longitudinal sectional view of the center part of the trigger-type pump dispenser according to the embodiment of the present invention, depicting a state of the trigger before rotation.

FIG. 2 is a longitudinal sectional view of the center part of the trigger-type pump dispenser A according to the embodiment of the present invention, depicting a state of the trigger before rotation.

Figure 3:
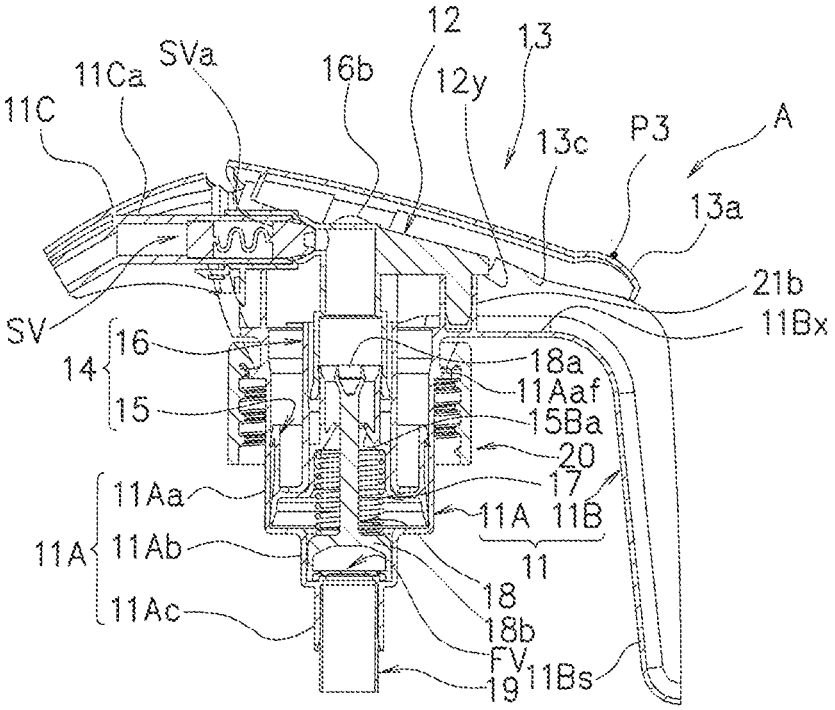
FIG. 3 is a longitudinal sectional view of the center part of the trigger-type pump dispenser according to the embodiment of the present invention, depicting a state of the trigger after rotation.

FIG. 3 is a longitudinal sectional view of the center part of the trigger-type pump dispenser A according to the embodiment of the present invention, depicting a state of the trigger after rotation.

As depicted in FIG. 2, the trigger-type pump dispenser A according to the embodiment of the present invention includes a housing 11, a nozzle base 12, the trigger 13, the piston structure 14, a hollow-shaped piston 15, a hollow-shaped piston shaft 16, a spring 17, a valve rod 18, a tube 19, and a cap 20.

Figure 4:
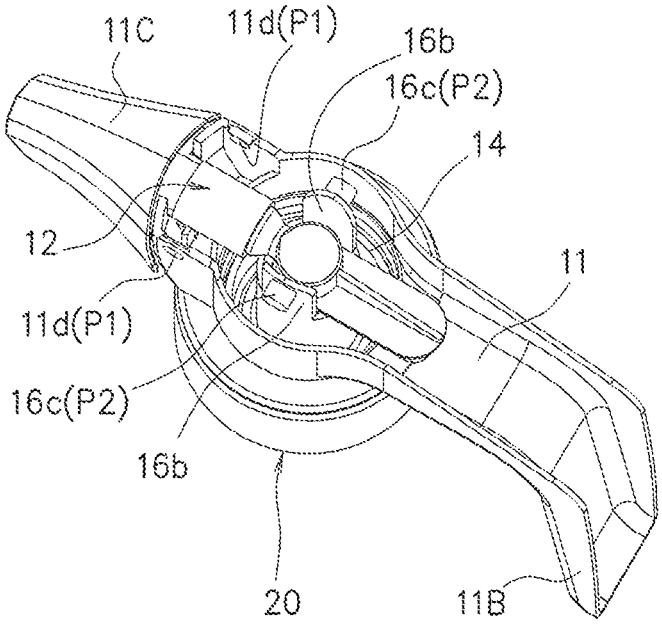
FIG. 4 is a perspective view depicting a state in which a housing, a nozzle base, and a piston structure for use in the trigger-type pump dispenser according to the embodiment of the present invention are assembled, with the trigger removed for depiction.

The housing 11 has a front cylinder part 11A and the rear inverted-L-shaped grip part 11B integrally formed (refer to FIG. 4).

Note that the cylinder part 11A is not depicted in FIG. 4 because of being inside the cap 20.

Also, the housing 11 has attached thereto a nozzle base, which will be described further below.

Also, the cylinder part 11A has a large diameter part 11Aa, an intermediate diameter part 11Ab, and a small diameter part 11Ac.

Note that the piston 15 slides inside this cylinder part.

A flange 11Aaf is formed on an outer circumference of the large diameter part 11Aa, and this flange 11Aaf is held tight by the cap 20, which will be described further below, to be attached to a container.

The inverted-L-shaped grip part 11B is positioned below the thumb pad part 13*a* of the trigger 13 at a rear end of the trigger 13, which will be described further below.

And, a finger abutting part 11Bs is on a side of the inverted-L-shaped grip part 11B opposed to the cap 20. This finger abutting part 11Bs is preferably at the rear of a force point P3 of the thumb pad part 13*a* of the trigger 13, which will be described further below.

The nozzle part 11C is positioned at the front of the housing 11 (refer to FIG. 4), is mounted on the nozzle base 12, and has its upper surface flush with an upper surface of the housing 11.

Inside the nozzle part 11C, a hollow cylindrical part 11Ca is provided.

Inside this hollow cylindrical part 11Ca of the nozzle part, a second valve SV having a valve body SVa is incorporated.

Figure 5A:
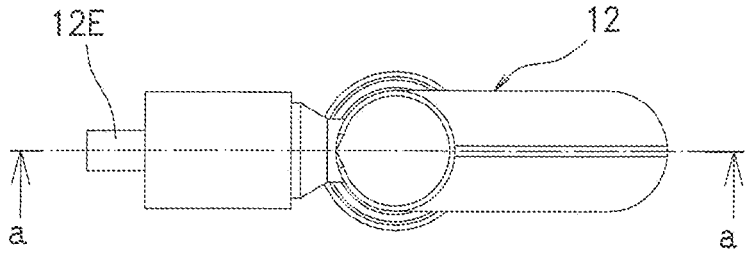
FIG. 5(A) is a plan view of the nozzle base.
Figure 5B:
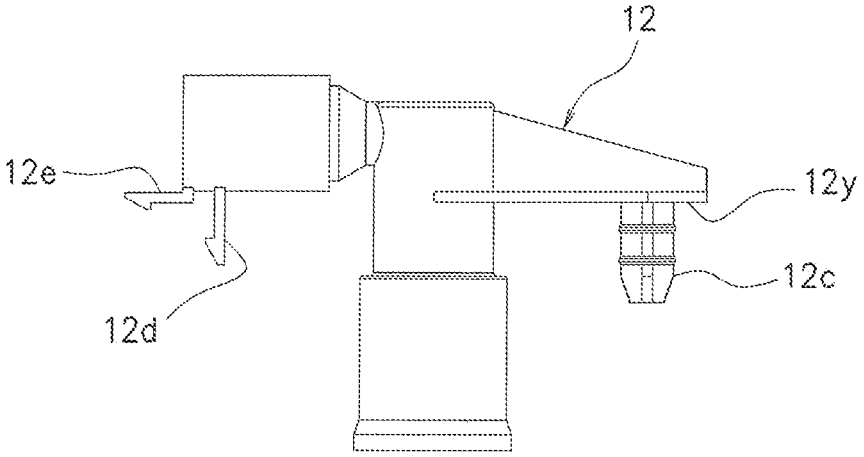
FIG. 5(B) is a front view of the nozzle base.
Figure 5C:
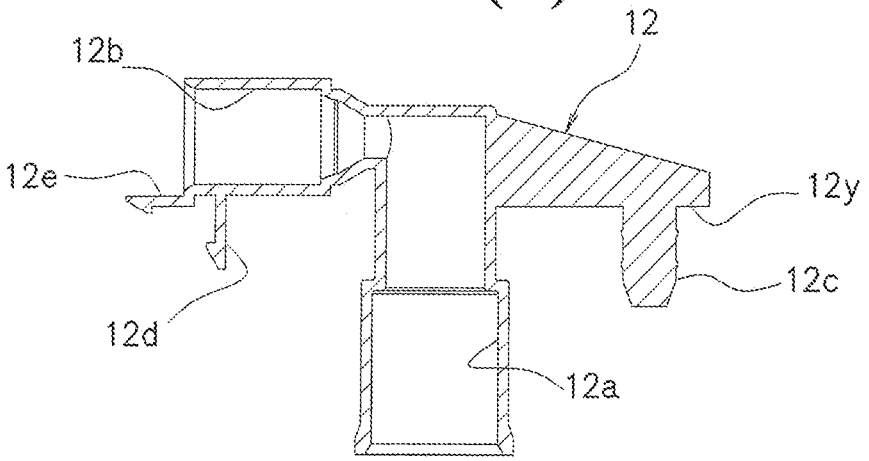
FIG. 5(C) is a sectional view of the nozzle base along an a-a section in FIG. 5(A).

And, the valve body SVa of the second valve SV abuts on a bottom part (serving as a valve seat function) of a hollow part 12*b* (refer to FIG. 5(C)) of the nozzle base 12 in the lateral direction.

As depicted in FIGS. 5(A) to 5(C), the nozzle base 12 has, at its front, the hollow part 12*b* in the lateral direction, and has, at its center, a hollow part 12*a* in a longitudinal direction.

Also, at its front, a latch nail 12*d* in the longitudinal direction and a latch nail 12*e* in the lateral direction are provided, and a fit-in protrusion 12*c* is provided at the rear.

Also, the trigger 13 is positioned above the housing 11, and has its front end part rotatably coupled to attachment holes 11*d* (refer to FIG. 4) of the housing 11.

That is, the portions of the above-mentioned attachment holes 11*d* to which the front end part of the trigger 13 is rotatably attached serve as rotation fulcrums P1 of the trigger 13.

Figure 9A:
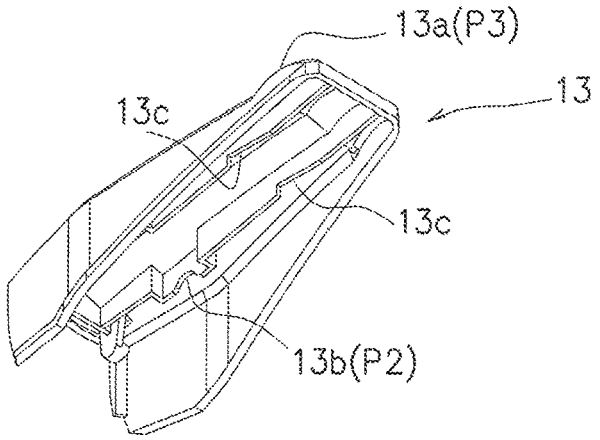
FIG. 9(A) is a perspective view of the trigger when viewed from below.
Figure 9B:
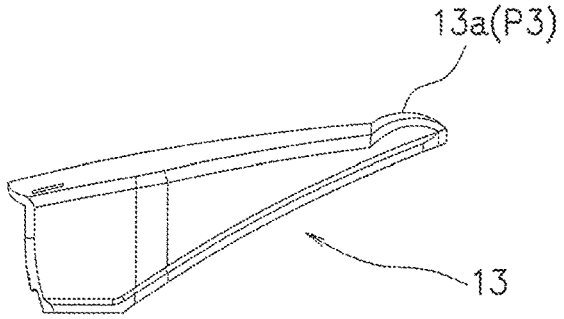
FIG. 9(B) is a front view of the trigger.

Also, as depicted in FIG. 2, FIG. 9(A), and FIG. 9(B), the thumb pad part 13*a* is formed at a rear tip of the trigger 13.

And, a center part of this thumb pad part 13*a* serves as the force point P3.

Figure 9C:
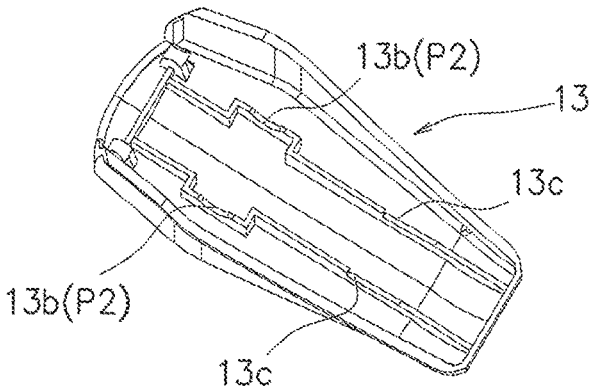
FIG. 9(C) is a perspective view of a rear surface of the trigger when viewed from below.

Also as depicted in FIG. 9(A) and FIG. 9(C), arc-shaped recesses 13*b* (two locations) and notches 13*c* (two locations) are formed on a rear surface of the trigger 13. The arc-shaped recesses 13*b* (two locations) are formed at a substantially mid part of the trigger 13, and the notches 13*c* (two locations) are formed at a portion near a rear end part of the trigger 13.

And, (two) support shafts 16*c* of a bifurcated part 16*b* of the hollow-shaped piston shaft 16, which will be described further below, abut on the arc-shaped recesses 13*b* (two locations) of the trigger 13.

The portions where the (two) support shafts 16*c* abut, that is, the arc-shaped recesses 13*b* (two locations), serve as points of application P2 of the trigger 13.

As described above, the stopper 21 can be inserted between the trigger 13 and the inverted-L-shaped grip part 11B.

And, the stopper 21 has an upper protruding part 21*a* and a lower side protruding part 21*b*.

The stopper 21 is caused to slide in a lateral direction along a horizontal plane part 11Bx of the grip part 11B to cause the upper protruding part 21*a* to be engaged in the notches 13*c* of the trigger 13 and also to cause the side protruding part 21*b* to fit in between the horizontal plane part 11Bx of the grip part 11B and a rear step part 12*y* of the nozzle base 12.

In this manner, the stopper 21 can be easily attached.

Also, to remove the stopper 21, the stopper 21 is drawn out oppositely to the above-described sliding direction, thereby allowing removal.

Figure 8A:
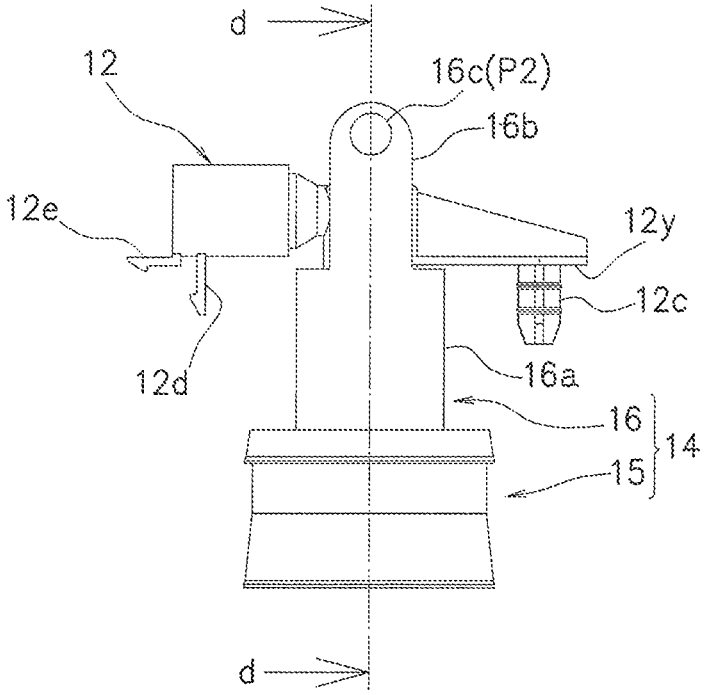
FIG. 8(A) is a front view of that assembled state and FIG. 8(B) is a sectional view of that assembled state along a d-d section in FIG. 8(A).
Figure 8B:
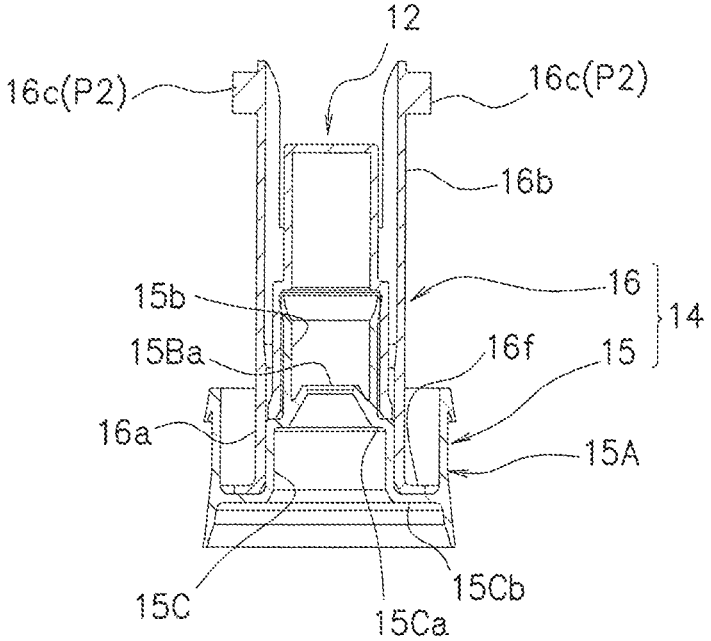

As depicted in FIG. 8(A) and FIG. 8(B), the piston structure 14 is configured of the hollow-shaped piston 15 and the hollow-shaped piston shaft 16.

Figure 6A:
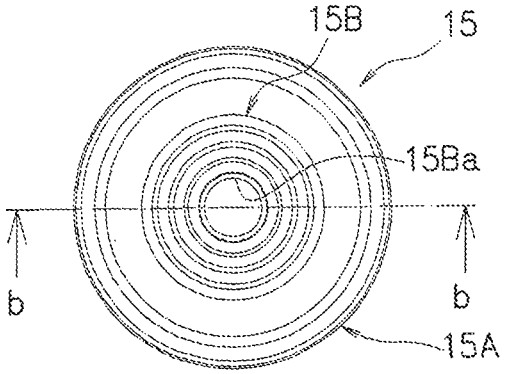
FIG. 6(A) is a plan view of the piston.
Figure 6B:
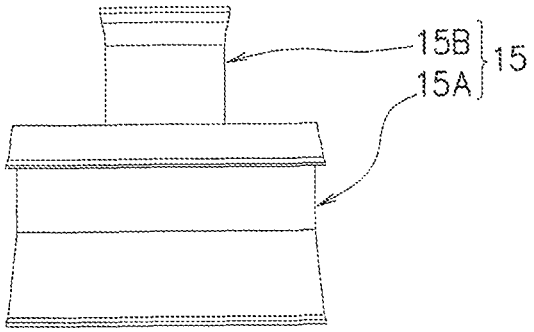
FIG. 6(B) is a front view of the piston.

First, as depicted in FIG. 6, the hollow-shaped piston 15 has a large-diameter piston part 15A, a small-diameter piston part 15B, and an intermediate-diameter mid part 15C integrally formed so as to have a same axis.

Figure 6C:
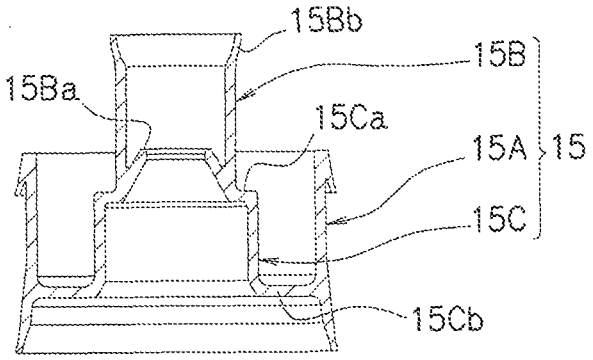
FIG. 6(C) is a sectional view of the piston along a b-b section in FIG. 6(A).
Figure 7A:
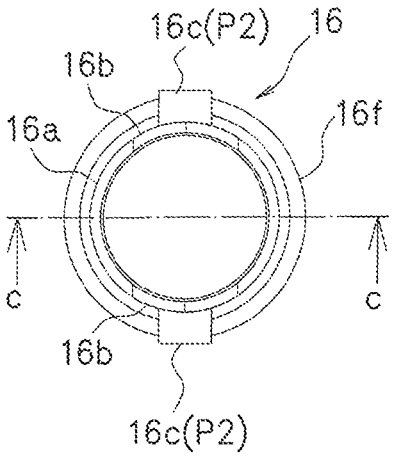
FIG. 7(A) is a plan view of the piston shaft.
Figure 7B:
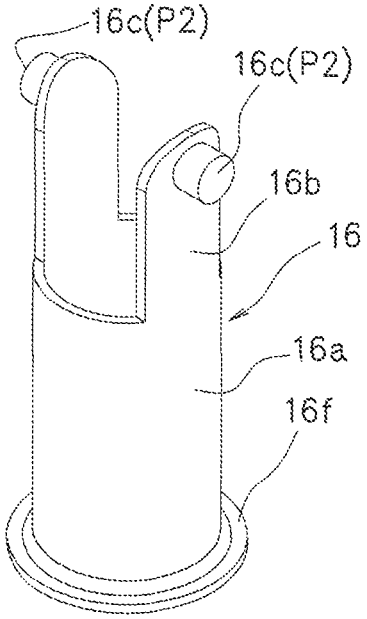
FIG. 7(B) is a perspective view of the piston shaft.
Figure 7C:
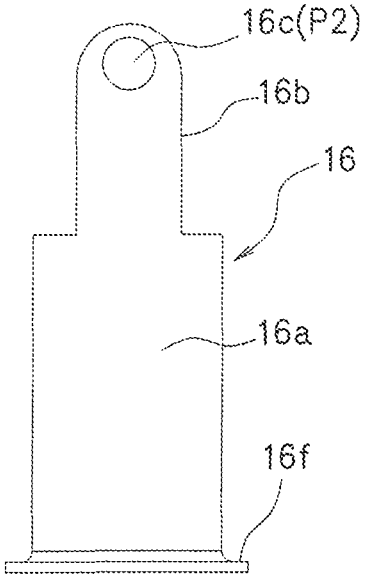
FIG. 7(C) is a front view of the piston shaft.
Figure 7D:
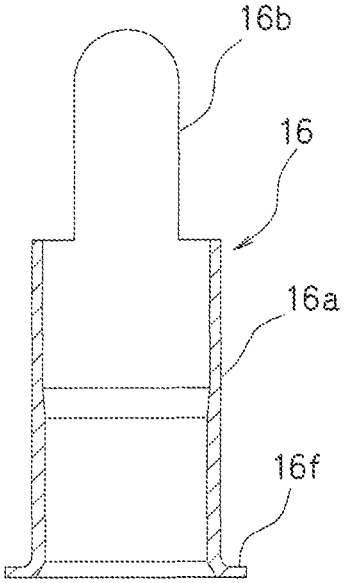
FIG. 7(D) is a sectional view of the piston shaft along a c-c section in FIG. 7(A).

That is, as depicted in FIG. 6(C), a lower end of the small-diameter piston part 15B is coupled to the intermediate-diameter mid part 15C at an upper coupling part 15Ca of the intermediate-diameter mid part 15C, and a portion near a lower end of the large-diameter piston part 15A is coupled to the intermediate-diameter mid part 15C at a lower coupling part 15Cb of the intermediate-diameter mid part 15C.

And, a lip part 15Ba is formed below the inside of the small-diameter piston part 15B, whose upper end has an outward flange part 15Bb formed thereat.

The small-diameter piston part 15B is slidably inserted into the hollow part 12*a* of the nozzle base 12 in the longitudinal direction.

In this state, the cylinder part 11A and the space inside the nozzle base 12 are sealed from outside.

As will be described further below, when the trigger 13 is operated to inject a liquid, this small-diameter piston part 15B vertically moves, but the nozzle base 12 does not vertically move, and therefore the nozzle part 11C does not move and its position does not change.

Also, the large-diameter piston part 15A is slidably inserted into the large diameter part 11Aa of the cylinder part 11A.

As depicted in FIGS. 7(A) to 7(D), in the hollow-shaped piston shaft 16, the bifurcated part 16*b* is formed on an upper part of a main body part 16*a*.

Also, the (two) support shafts 16*c* protrude from an outer side surface of an upper portion of the bifurcated part 16*b*.

As described above, the (two) support shafts 16*c* abut on the arc-shaped recesses 13*b* (two locations) of the trigger 3.

And, the portions where the (two) support shaft 16*c* abut, that is, the arc-shaped recesses 13*b* (two locations), serve as the points of application P2 of the trigger 13.

Also, a flange 16*f* protrudes from outside of a lower end of the main body part 16*a*.

And, as depicted in FIG. 8(B), in the hollow-shaped piston shaft 16, the flange 16*f* at the lower end part of the main body part 16*a* abuts on the above-described lower coupling part 15Cb (refer to (C) of FIG. 6) of the intermediate-diameter mid part 15C.

The spring 17 is a coil spring, pressing the piston structure 14 formed of the hollow-shaped piston 15 and the hollow-shaped piston shaft 16 upward.

An upper end part of the spring 17 abuts on a rear side of the upper coupling part 15Ca of the intermediate-diameter mid part, and a lower end part of the spring 17 abuts on an upper surface of an enlarged part 18*b* at a lower part of the valve rod 18, which will be described further below.

And, when the thumb pad part 13*a* of the trigger 13 is pressed down by the thumb to rotate the trigger 13, the piston structure 14 formed of the hollow-shaped piston 15 and the hollow-shaped piston shaft 16 moves downward to compress the spring 17.

Also, when pressing-down of the thumb pad part 13*a* is suspended, the spring 17 is expanded to press the piston structure 14 formed of the hollow-shaped piston 15 and the hollow-shaped piston shaft 16 upward.

And, when the piston structure 14 is pressed upward, the support shafts 16*c* (fitting in the arc-shaped recesses 13*b* of the trigger 13) of the hollow-shaped piston shaft 16 are pushed up to cause the trigger 13 to return to the original position.

In this manner, the spring 17 functions as a return spring of the trigger 13.

The valve rod 18 is disposed at a center part inside the large diameter part 11Aa and the intermediate diameter part 11Ab of the cylinder part 11A.

The valve rod 18 includes, at its tip part, a valve body 18*a* having a valve function in cooperation with the above-described lip part 15Ba of the small-diameter piston part 15B, and includes the enlarged part 18*b* at its lower base end part.

And, this enlarged part 18*b* of the valve rod 18 is accommodated inside the intermediate diameter part 11Ab of the housing 11.

Also, this enlarged part 18*b* includes a gap with an open lower end, and this open part of the gap includes a first valve FV.

Figure 10A:
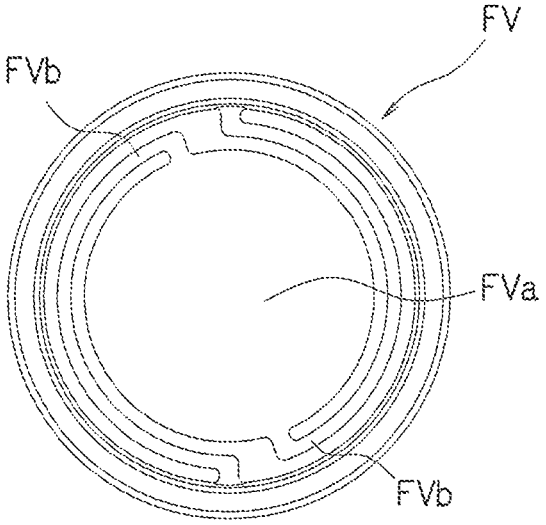
FIG. 10(A) is a plan view of the first valve and FIG. 10(B) is a sectional view of the first valve.
Figure 10B:
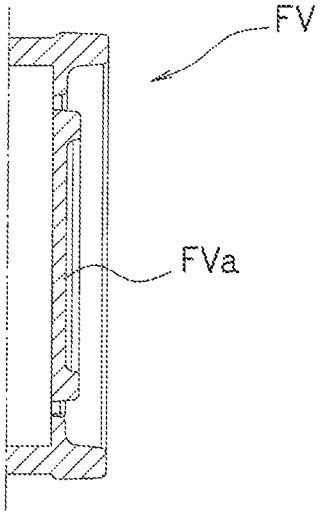

A general outline of the first valve FV is depicted in FIG. 10. As depicted in FIG. 10(A), the first valve FV is configured of a valve body FVa and (two) plate spring parts FVb.

And, the plate spring parts FVb support and press the valve body FVa.

Also, the valve body FVa is opposed to a portion annularly protruding slightly upward from the intermediate diameter part 11Ab of the housing 11 (that is, a portion acting as a valve seat).

With the valve body FVa going away from this annularly protruding portion, the valve is opened.

As depicted in FIG. 2 and FIG. 3, the tube 19 is attached as being inserted into the small diameter part 11Ac of the cylinder part 11A.

And, above an opening of an upper end part of the tube 19, the above-described first valve FV is positioned.

As depicted in FIG. 2 and FIG. 3, the cap 20 is to attach the housing 11 to the container, attaching as being screwed into an outlet part of the container by using the flange 11Aaf of the housing 11.

Note that, preferably, the above-described hollow-shaped piston 15 is made of polyethylene, and the others including the housing 11, the nozzle base 12, the trigger 13, the hollow-shaped piston shaft 16, the valve rod 18, the tube 19, the cap 20, and the stopper 21 are all made of polypropylene.

Note that these are not necessarily restricted to be made of polyethylene or polypropylene.

Next, actuation of the trigger-type pump dispenser A according to the embodiment of the present invention is described.

First, the stopper 21 (refer to FIG. 1) inserted between the trigger 13 and the inverted-L-shaped grip part 11B is removed to cause a state in which the thumb pad part 13*a* of the trigger 13 can be pressed down by the thumb.

Next, as depicted in FIG. 3, the inverted-L-shaped grip part 11B and the trigger 13 are gripped and the thumb pad part 13*a* of the trigger 13 is pressed down by the thumb, the trigger 13 rotates about the fulcrums P1 until abutting on the upper surface of the nozzle base 12.

When the inverted-L-shaped grip part 11B and the trigger 13 are gripped and the thumb pad part 13*a* of the trigger 13 is pressed down by the thumb to cause the trigger 13 to rotate about the fulcrums P1, the hollow-shaped piston 15 also moves downward via the hollow-shaped piston shaft 16 in an interlocked manner with the movement of the trigger 13, and the liquid pressure inside the large diameter part 11Aa and the intermediate part 11Ab of the cylinder part 11A is increased.

Note that when the liquid pressure inside the intermediate diameter part 11Ab is increased, the first valve FV is closed.

When the piston structure 14 formed of the hollow-shaped piston 15 and the hollow-shaped piston shaft 16 moves downward against the returning force of the spring 17, the valve body 18*a* of the valve rod 18 is released from a contact with the lip part 15Ba of the small diameter piston part 15B, and the inside of the large diameter part 11Aa of the cylinder part 11A communicates the hollow part 12*a* (refer to FIG. 5(C)) in the longitudinal direction of the nozzle part 12.

Thus, the increased liquid pressure inside the hollow part 12*a* in the longitudinal direction acts on the valve body SVa to open the second-valve valve body SV.

Thus, the liquid is injected from the nozzle part 11C.

In this case, with the rotation of the trigger 13 about the fulcrums P1, even if the hollow-shaped piston 15 moves downward, the nozzle part 11C does not move and is at a fixed position.

Also, as depicted in FIG. 2, when the pressing force from the trigger 13 by the thumb is released, by the returning force of the spring 17, the piston structure 14 formed of the hollow-shaped piston shaft 16 and the hollow-shaped piston 15 ascends to return to the original position.

Note that in the trigger 13, since the (two) support shafts 16*c* of the hollow-shaped piston shaft 16 abut on the arc-shaped recesses 13*b* (two locations) of the trigger 13, the trigger 13 is also rotated and returned to the original position by the returning force of the spring 17.

When the hollow-shaped piston 15 ascends, the inside of the cylinder part becomes at a negative pressure. Thus, the second valve SV is closed, the first valve FV is opened, and the liquid inside the container main body is drawn up via the tube 19.

Here, when the hollow-shaped piston 15 ascends to be returned to the original position, the valve body 18*a* of the valve rod 18 makes contact with the lip part 15Ba of the small-diameter piston part 15B, and the communication between the large diameter part 11Aa of the cylinder part 11A and the hollow part 12*a* (refer to FIG. 5(C)) of the nozzle base 12 in the longitudinal direction is interrupted.

Thus, liquid leakage to the outside is prevented.

The trigger-type pump dispenser A according to the embodiment of the preset invention has the following effects.

Even if the trigger 13 vertically rotates, the position of the nozzle part 11C does not change, and therefore the liquid injecting direction can be accurately defined toward a target.

Also, since the vertical movement of the hollow-shaped piston 15 can be made via the hollow-shaped piston shaft 16, the inner space of the housing 11 can be reduced.

Also, since the inverted-L-shaped grip part 11B is positioned under the trigger 13, when the trigger 13 for injecting the liquid is pulled in, a grip is good, and the whole trigger-type pump dispenser A is not required to be gripped.

Also, in a state in which four fingers are hooked on the inverted-L-shaped grip part 11B, the thumb is put on the thumb pad part 13*a* of the trigger 13, and a simple press downward is enough.

Thus, the dispenser can be easily handled even by a child with small hands, a handicapped person with decreased grip power or finger power, or the like.

Furthermore, even if a liquid is affixed to the trigger-type pump dispenser A itself, the hand is away from the trigger-type pump dispenser A itself, and is therefore not soiled.

Also, the trigger-type pump dispenser A is such that, in a state in which the inverted-L-shaped grip part 11B is gripped, the trigger 13 above the inverted-L-shaped grip part 11B is pressed down to cause a liquid inside the cylinder part 11A to be injected from the nozzle part 11C. Since the finger abutting part 11Bs of the inverted-L-shaped grip part 11B is at the rear of the force point P3 of the thumb pad part 13*a* of the trigger 13, a grip is good, and holding capability is high.

Also, finger power is efficiently transmitted, and operability is excellent.

Also, with the stopper 21 inserted between the trigger 13 and the inverted-L-shaped grip part 11B, the trigger 13 can be prevented from being pressed down due to some circumstances during storage or during delivery of the trigger-type pump dispenser A.

And, as described above, insertion, that is, attachment, and removal of the stopper 21 can be easily made by sliding along the horizontal plane part 11Bx of the grip part 11B.

While the suitable embodiment of the present invention has been described in the foregoing, the present invention is not restricted to the above embodiment.

Figure 11:
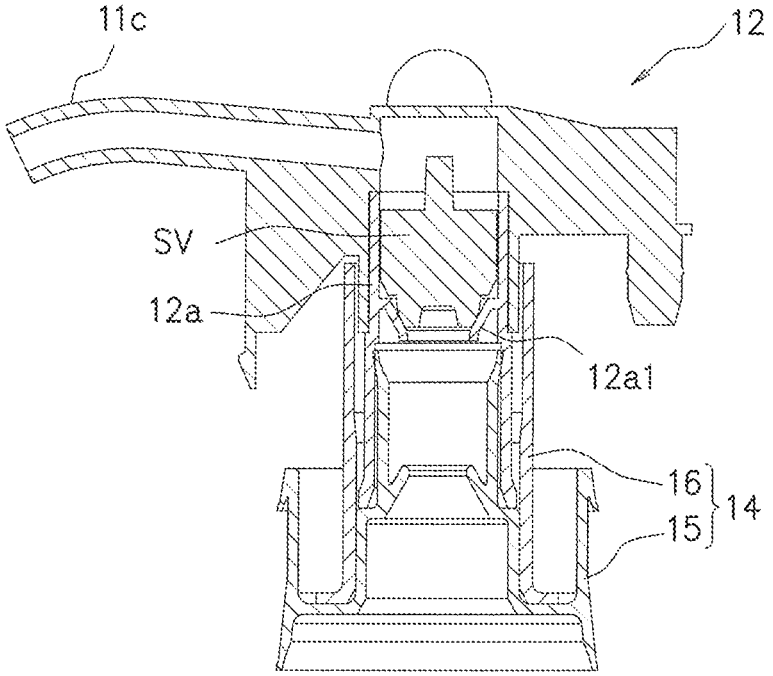
FIG. 11 is a sectional view depicting another modification example of the nozzle base.

For example, FIG. 11 is a sectional view depicting a modification example of the nozzle base 12.

In this case, unlike the above-described nozzle part 11C of FIG. 1, this nozzle part 11C is integrally formed with the nozzle base 12.

Also, unlike the nozzle base 12 of FIG. 1, the hollow part 12*a* in the longitudinal direction is a component separate from the nozzle base 12. Also, the second valve SV is mounted on this hollow part 12*a* in the longitudinal direction.

And, the hollow part 12*a* in the longitudinal direction has an upper lip part 12*a*1 formed, which cooperates with the valve body of the second valve SV to exert a valve open/close function.

Figure 12A:
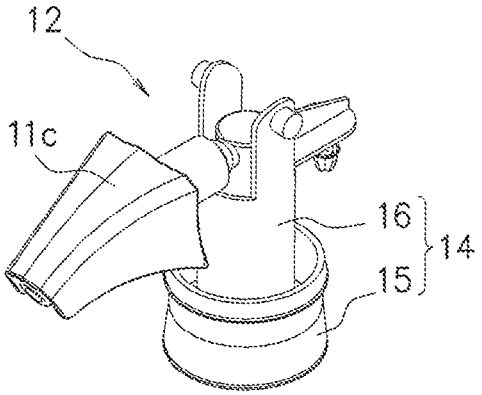
FIG. 12 is a diagram depicting, for reference, comparison between the above-described embodiment and a nozzle base 12 of FIG. 11.
Figure 12B:
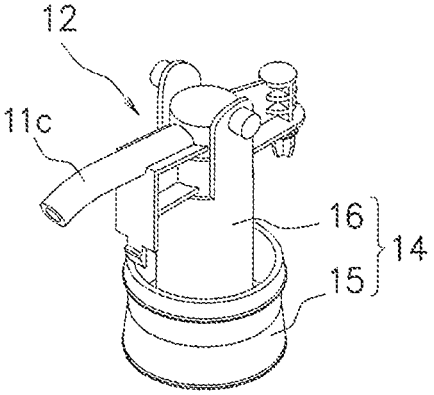

Also, FIG. 12 is a diagram depicting, for reference, comparison between the above-described embodiment (FIG. 1 to FIG. 10) and the nozzle base 12 of FIG. 11.

(A) depicts the nozzle base 12 of the above-described embodiment, and (B) depicts the nozzle base 12 of FIG. 11.

In any case, the nozzle base 12 does not vertically move, and the nozzle part 11C has an unmovable structure.

INDUSTRIAL APPLICABILITY

The present invention can be applied to, for example, general industries as coating purposes or fields of medical equipment and so forth, as long as they use the liquid injection principle of the present invention.

REFERENCE SIGNS LIST

11 . . . housing
11*d* . . . attachment hole
11A . . . cylinder part
11Aa . . . large diameter part
11Aaf . . . outer circumferential flange
11Ab . . . intermediate diameter part
11Ac . . . small diameter part
11B . . . inverted-L-shaped grip part

11Bs . . . finger abutting part
11Bx . . . horizontal plane part of the grip part
11C . . . nozzle part
11Ca . . . hollow cylindrical part of the nozzle part
12 . . . nozzle base
12*a* . . . hollow part in a longitudinal direction
12*b* . . . hollow part in a lateral direction
12*c* . . . fit-in protrusion
12*d* . . . latch nail in a longitudinal direction
12*e* . . . latch nail in a lateral direction
12*y* . . . rear step part of the nozzle base
13 . . . trigger
13*a* . . . thumb pad part of the trigger
13*b* . . . arc-shaped recess of the trigger
13*c* . . . notch of the trigger
14 . . . piston structure
15 . . . hollow-shaped piston
15A . . . large-diameter piston part
15B . . . small-diameter piston part
15Ba . . . lip part of the small-diameter piston part
15Bb . . . flange part
15C . . . intermediate-diameter mid part
15Ca . . . upper coupling part of the intermediate-diameter mid part
15Cb . . . lower coupling part of the intermediate-diameter mid part
16 . . . hollow-shaped piston shaft
16*a* . . . main body part
16*b* . . . bifurcated part
16*c* . . . support shaft
16*f* . . . flange
17 . . . spring
18 . . . valve rod
18*a* . . . valve body
18*b* . . . enlarged part
19 . . . tube
20 . . . cap
21 . . . stopper
21*a* . . . upper protruding part
21*b* . . . side protruding part
SV . . . second valve
SVa . . . valve body of the second valve
FV . . . first valve
FVa . . . valve body of the first valve
FVb . . . plate spring part of the first valve
P1 . . . fulcrum
P2 . . . point of application
P3 . . . force point
A . . . trigger-type pump dispenser

The invention claimed is:

1. A pump dispenser attachable to a container, comprising:

a housing with a front cylinder part and a rear inverted-L-shaped grip part integrally formed, a nozzle base attached to the housing and having a front nozzle part mounted thereon;

a piston structure configured of a hollow-shaped piston and a hollow-shaped piston shaft and sliding inside the cylinder part;

a spring which presses the hollow-shaped piston and the hollow-shaped piston shaft upward;

a trigger positioned above the housing, having a front tip rotatably mounted on the housing, and having a mid part where a tip of the piston shaft abuts; and a valve rod disposed at a center part inside the cylinder part, wherein the hollow-shaped piston is integrally formed so that a larger-diameter piston part, a smaller diameter piston part, and an intermediate-diameter mid part have a same axis center, the intermediate-diameter mid part has a diameter smaller than the larger-diameter piston part and larger than the smaller diameter piston part, and the smaller diameter piston part has a lip part inside, the valve rod has a first end part, a second end part at an opposite end from the first end part, a valve body having a valve function in cooperation with the lip part at the first end, and an enlarged part at the second end part, and a finger abutting part of the inverted-L-shaped grip part is at rear of a force point of a thumb pad part of the trigger.

2. The pump dispenser according to claim 1, wherein the hollow-shaped piston shaft has an upper part formed into a bifurcated part, tip parts of the bifurcated part abutting on the trigger, and a lower part incorporated in the hollow-shaped piston.

3. The pump dispenser according to claim 2, wherein support shafts each protrude from an outer side surface of a respective one of the tip parts of the bifurcated part.

4. The dispenser according to claim 1, wherein the smaller diameter piston part of the piston structure is freely slidable inside a hollow part in a longitudinal direction formed in the nozzle base, and movement of the piston structure is not transmitted to the nozzle base.

5. The pump dispenser according to claim 1, wherein a stopper is inserted between the trigger and the inverted-L-shaped grip part.

* * * * *